US007039345B2

(12) United States Patent
Miller

(10) Patent No.: US 7,039,345 B2
(45) Date of Patent: May 2, 2006

(54) TONER CARTRIDGE HAVING A SIFTING AGITATOR

(76) Inventor: Steven Miller, 3750-A Airport Blvd. Unit 141, Mobile, AL (US) 36608

( * ) Notice: Subject to any disclaimer, the term of this patent is extended or adjusted under 35 U.S.C. 154(b) by 0 days.

(21) Appl. No.: 10/907,471

(22) Filed: Apr. 1, 2005

(65) Prior Publication Data

US 2005/0163536 A1 Jul. 28, 2005

Related U.S. Application Data

(63) Continuation of application No. 10/742,323, filed on Dec. 19, 2003.

(60) Provisional application No. 60/521,326, filed on Apr. 1, 2004.

(51) Int. Cl.
*G03G 15/08* (2006.01)

(52) U.S. Cl. ..... 399/254; 399/119; 399/260; 399/263

(58) Field of Classification Search ..... 222/DIG. 1; 399/119, 254, 255, 256, 260, 262, 263, 120
See application file for complete search history.

(56) References Cited

U.S. PATENT DOCUMENTS

| | | | | |
|---|---|---|---|---|
| 5,875,378 | A | 2/1999 | Campbell et al. | |
| 6,459,876 | B1 * | 10/2002 | Buchanan et al. | 399/254 |
| 6,546,213 | B1 | 4/2003 | Ito et al. | |
| 6,654,569 | B1 | 11/2003 | Nozawa | |
| 6,771,922 | B1 * | 8/2004 | Blanck et al. | 399/260 |

* cited by examiner

*Primary Examiner*—Hoang Ngo
(74) *Attorney, Agent, or Firm*—Smith & Hopen, P.A.; Thomas E. Toner

(57) ABSTRACT

A toner cartridge with a uni-body construction reduces the cost of production as well as reducing the chance of failure during use. The toner cartridge includes a waste bin having a leading end that can be sculpted to mate with the cartridge-receiving cavities of a large number of printers. Additional improvements include an improved toner sifting agitator. The sifting action ensures that toner stays sufficiently fluid, and distributes evenly on the toner adder roller.

11 Claims, 19 Drawing Sheets

TONER CARTRIDGE HAVING A SIFTING AGITATOR

CROSS REFERENCE TO RELATED APPLICATIONS

This application claims priority to U.S. Provisional Patent Application No. 60/521,326, entitled, "Total Cartridge," filed Apr. 1, 2004 and co-pending U.S. patent application Ser. No. 10/742,323 entitled "Removable Toner Cartridge Universal Adapter," filed Dec. 19, 2003.

BACKGROUND OF THE INVENTION

Laser printers use a coherent beam of light, hence the term "laser printer," to expose discrete portions of an image transfer drum thus attracting the printing toner. Toner is a mixture of pigment (most commonly black) and plastic particles. The toner becomes electrostatically attracted to exposed portions of the image transfer drum. The toner transfers to paper, or other medium, as it passes over the rotating image transfer drum. Subsequently, the paper is heated so that the plastic is melted thereby permanently affixing the ink to the paper.

The vast majority of commercially available desktop laser printers include replaceable or removable toner cartridges that incorporate an image transfer drum, a toner tank, and a metering system. A drive mechanism connects to the drum and metering system. Modern toner cartridges often include a variety of sensors that interact with the laser printer to indicate the status of the cartridge. Indications relating to toner level, print quality and general cartridge function are often included as well. A large number of types and sizes of toner cartridges are currently available. The sensing system typically includes an encoder wheel interconnected with a rotating beater blade within a cylindrical toner tank. Movement of the beater blade feeds toner into the metering system. The encoder wheel reports the movement of the beater wheel through the rear housing.

Previously, certain printers in the electro-photography industry have produced inconsistent images as a result of toner particles being unevenly distributed. What is therefore needed is a means of uniformly distributing toner as it leaves the hopper across the toner adder roller, thereby eliminating the clumping of toner particles.

SUMMARY OF INVENTION

The long-standing but heretofore unfulfilled need for a toner cartridge that is adapted to be of an integrated construction, thereby limiting the number of elements required during manufacture, and which also includes improvements that overcome the limitations of prior art toner cartridges is now met by a new, useful, and non-obvious invention.

The novel toner cartridge includes a waste bin at the leading end of the toner cartridge. A main body connects to the waste bin at a trailing end of the waste bin. The waste bin and main body fixedly interconnect to one another and are held against movement relative to one another when fully installed within said toner cartridge receiving cavity. A rear housing connects to the main body at the trailing end of the main body thereby defining a toner chamber therein. The rear housing and main body fixedly interconnect to one another and being held against movement relative to one another when manufactured. This construction creates a unibody cartridge with fewer connecting parts and no pivotal joints, which, as in the prior art, can fail.

In an alternate embodiment, the waste bin includes a leading end sculpted to mate with the cartridge receiving cavity of a plurality of printers. The waste bin connects to the main body by fasteners chosen from the group consisting of adhesives, dovetail joinery, and mechanical fasteners.

In another embodiment, the novel toner cartridge includes a toner cartridge adapted to fit within a toner cartridge-receiving cavity of a printer, comprising a main body, a toner chamber connected to the main body at the trailing end of the main body having an exit surface to deliver toner from the toner chamber, and a sifting agitator having a first end and a second end extending across the exit surface capable of lateral movement across the exit surface. The novel toner cartridge further comprises a cam gear having a high surface and a low surface disposed at a first end of the sifting agitator such that rotation of the cam gear alternately engages and disengages the first end of the sifting agitator as the cam gear rotates. A resilient member mounts to one end of the sifting agitator for exerting force on the agitator to return the agitator to a home position. The resilient member is mounted on the sifting agitator and has a portion engaging the interior of the toner chamber.

The sifting agitator includes a plurality of lower chamber contouring fins spaced along the longitudinal axis of the sifting agitator adapted to move in lateral relation to the toner adder roller. A plurality of upper fins spaced along the longitudinal axis of the sifting agitator are adapted to contour the toner chamber. A cam pin disposed at the first end of the sifting agitator to engages the high surface of the cam gear as it rotates urging the sifting agitator to move laterally away from the cam gear.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel toner cartridge has a photoconductive drum on which an electrostatic image is formed. The photoconductive drum rotates in a plane perpendicular to that of the print medium passing through the toner cartridge. A recovery blade is in direct contact with the photoconductive drum. During the imaging stage, the photoconductive drum is exposed to light, usually a laser, which imprints a latent image thereon. A developing roller converts the electrostatic-image into a toner-image. Toner is then transferred to the print medium by means of static electricity, an opposite polar charge on the print medium, established by a transfer roller. The recovery blade then scrapes the waste toner from the photoconductive drum and directs it to the waste bin.

Construction of the Novel Toner Cartridge

Figure 1:
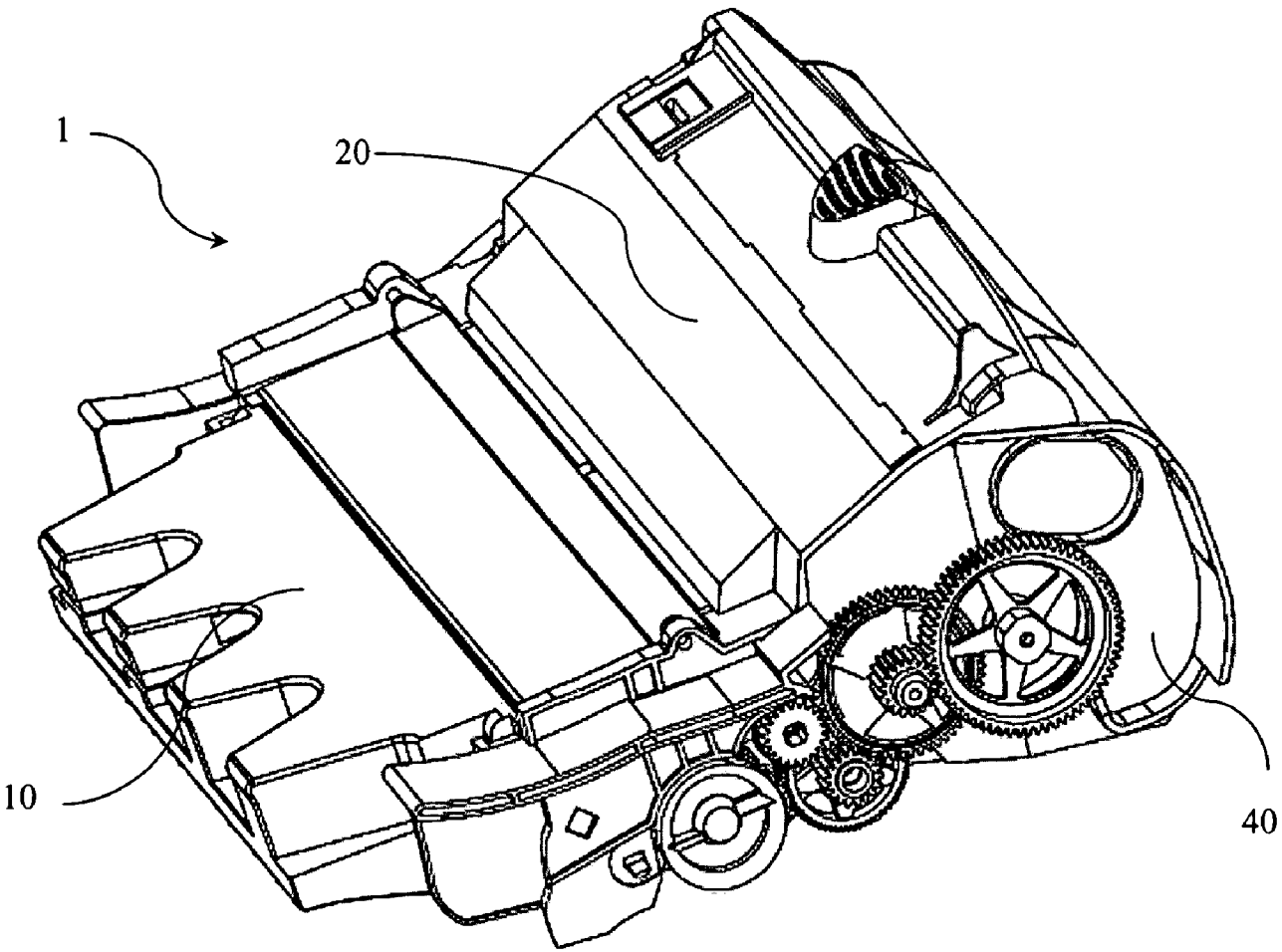
FIG. 1 is a perspective view of the novel toner cartridge.
Figure 2:
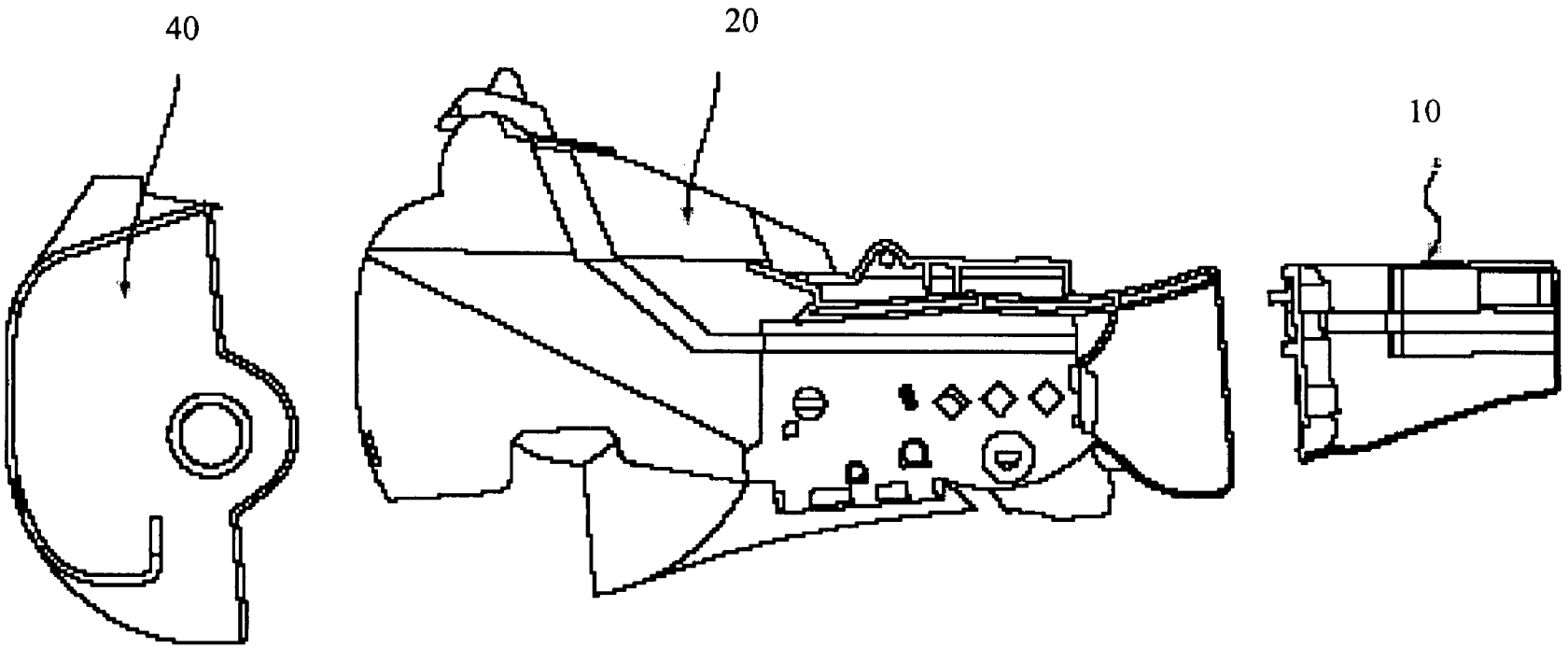
FIG. 2 is an exploded perspective view of the novel toner cartridge.
Figure 3:
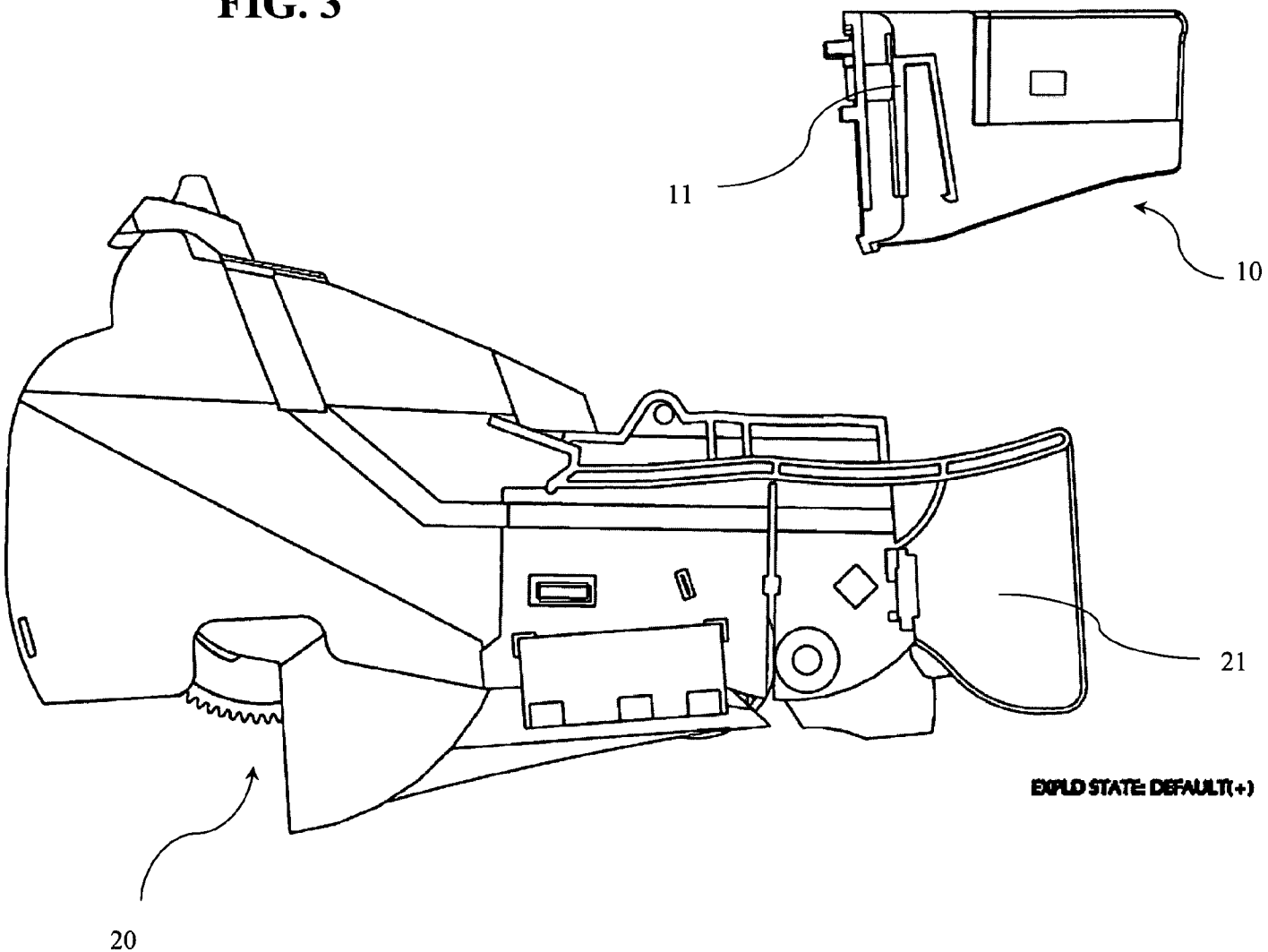
FIG. 3 is an exploded perspective view of the novel toner cartridge.
Figure 4:
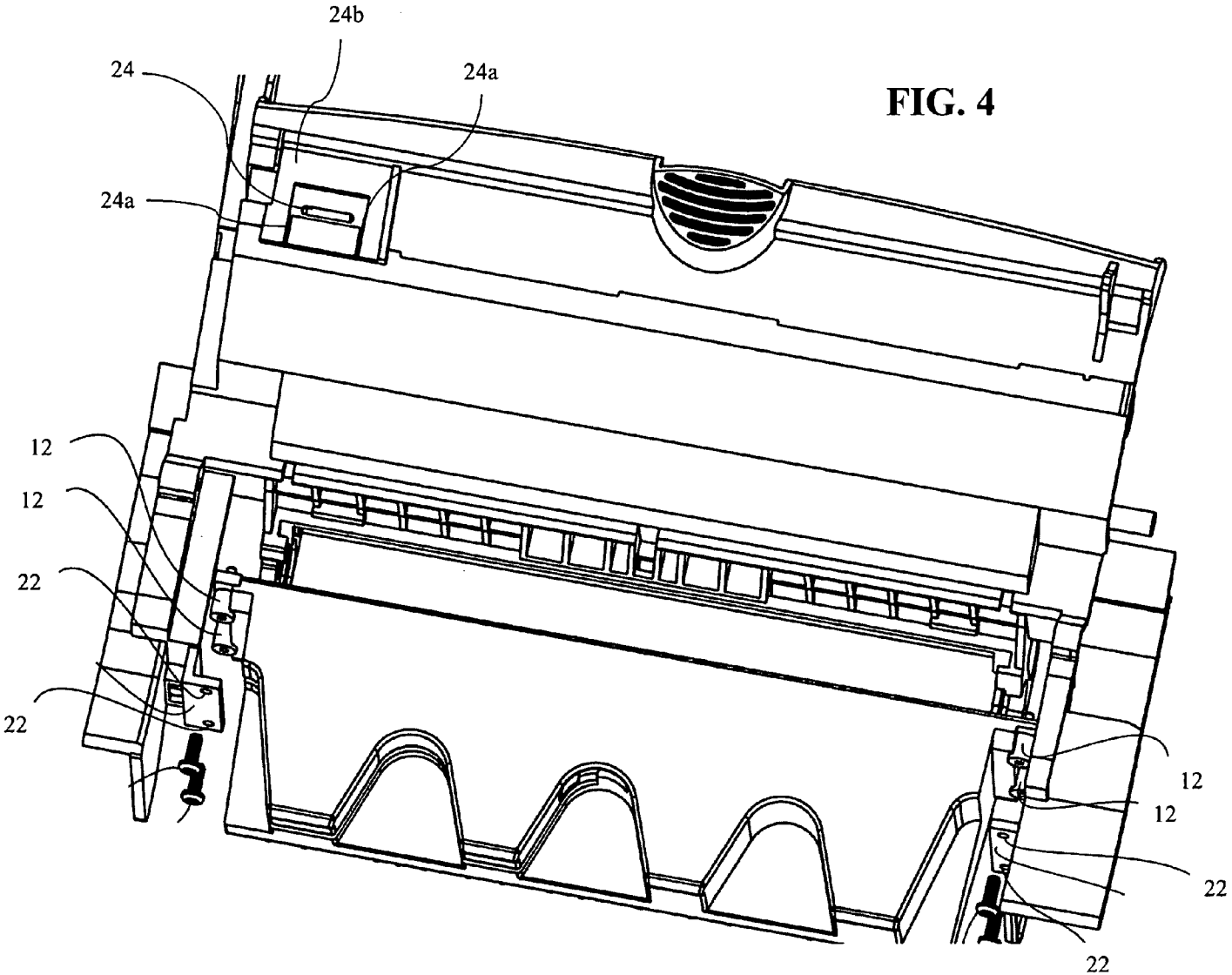
FIG. 4 is a top perspective view of the novel toner cartridge showing one means of fastening the waste bin to the main body.
Figure 5:
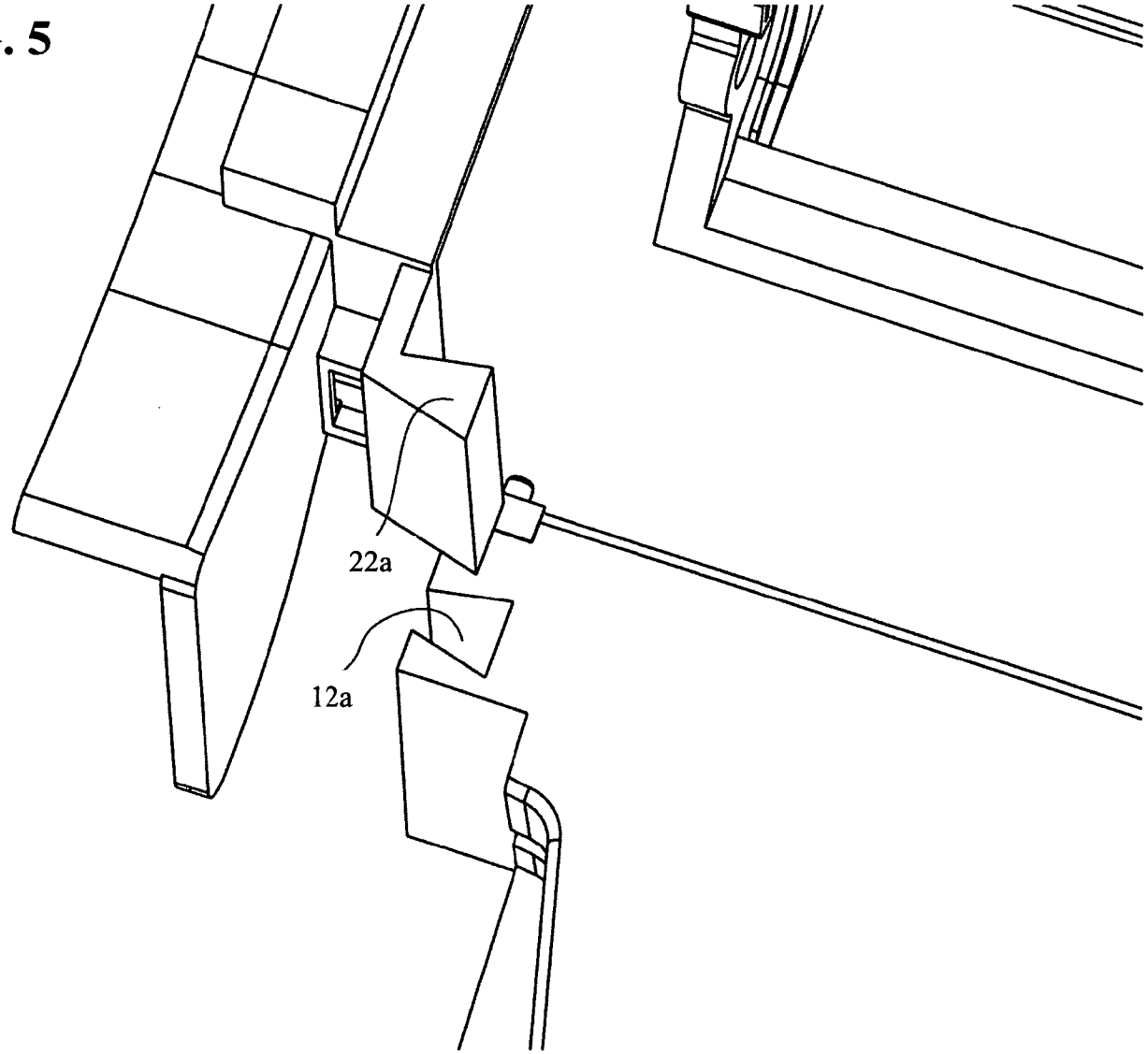
FIG. 5 is an exploded perspective view of the novel toner cartridge showing an alternate means of fastening the waste bin to the main body.

Referring now to FIGS. 1 and 2, it will be seen that the reference numeral 1 denotes an illustrative embodiment of the novel toner cartridge as a whole. Novel toner cartridge 1 is made by interconnecting waste bin 10 and rear housing 40 to main body 20. Specifically, as suggested by the alignment of parts in FIG. 3, trailing end of waste bin 10 connects to the leading end of main body 20. In similar fashion, the leading end of rear housing 40 connects to the trailing end of main body 20 (FIG. 2). FIGS. 4 and 5 illustrate possible methods of connecting waste bin 10 with main body 20. In one embodiment (FIG. 3) waste bin 10 is positioned over the leading end of main body 20 and then lowered until the two parts are interconnected via correlating connecting mechanisms 11 located on waste bin 10 and the leading end of main body 21. Illustrative embodiments of how waste bin 10 connects to main body 20 are disclosed more fully herein.

Waste Bin: The waste bin is attached to the main body either permanently or by releasable means, for the purposes of maintenance. When employing mechanical fasteners, the fasteners (FIG. 4), are located in predetermined locations such as by way of precisely positioned screw-bosses 12 located on waste bin 10, that mate with holes 22 formed in receiving tabs on main body 20. An alternative attachment method, FIG. 5, is achieved by means of an integral fastener received by a flared receiving channel 12*a*, much like a dove-tail joint, on waste bin 10 that accepts a pin 22*a*, on main body 20 by way of a sliding action whereby the pin and channel interlock. The wiper blade and the recovery blade are integrated with the front section.

Figure 6:
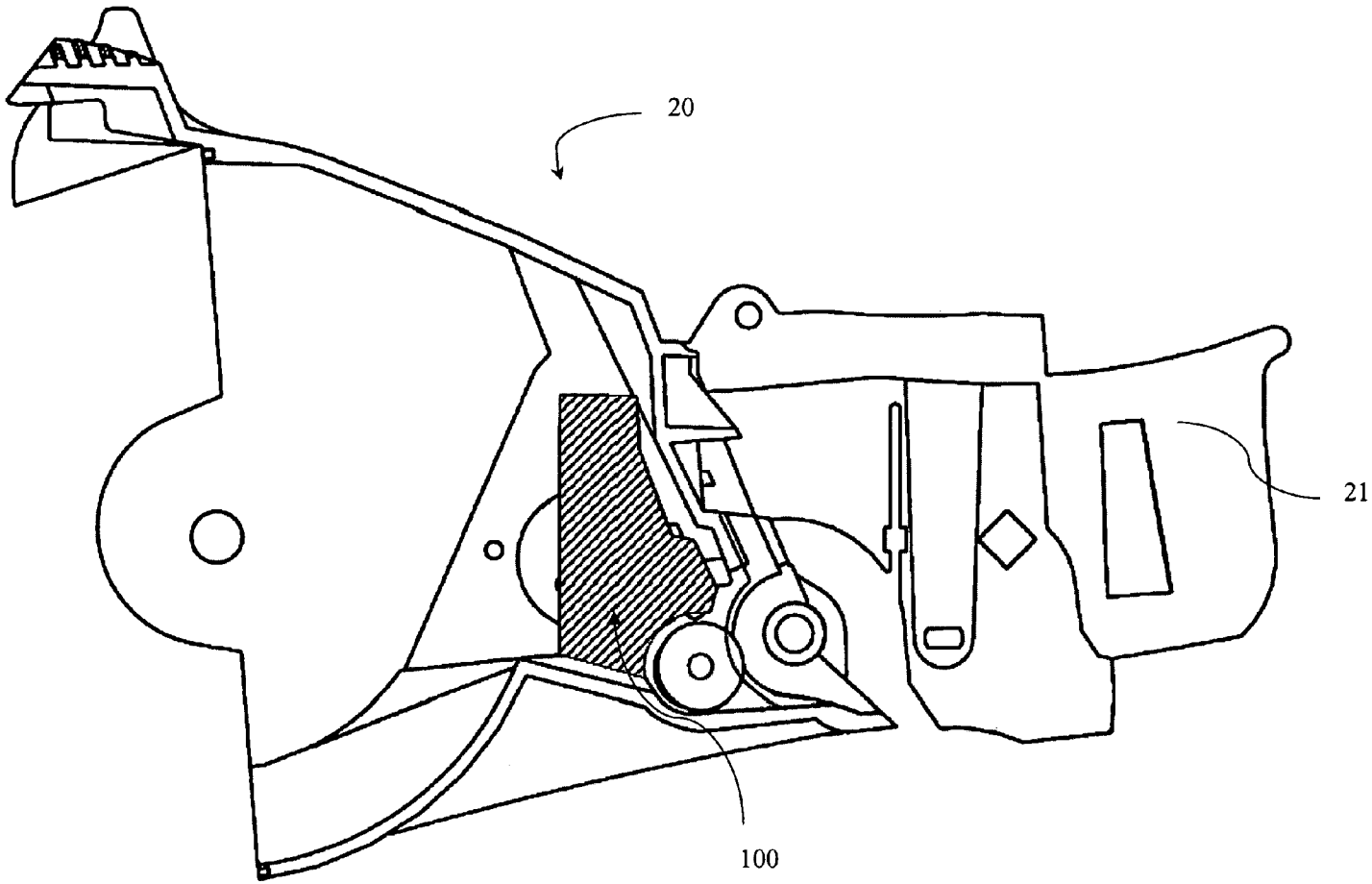
FIG. 6 is a side cross-section view of the main body of the novel toner cartridge.

Main Body: FIG. 6 shows the construction of main body 20 independent of waste bin 10 and rear housing 40. Main body 20 houses the doctor bar & spring, developer roller, toner adder roller, photoconductive drum, sealing members and a toner sifter (not shown). At its leading end, main body 20 has two extensions 21 at its lateral ends adapted to receive waste bin 10 (as discussed supra). Doctor bar & spring, developer roller, toner adder roller, photoconductive drum, sealing members and a toner sifter (not shown) are located between extensions 21 and in trailing relation to waste bin 10.

Figure 7:
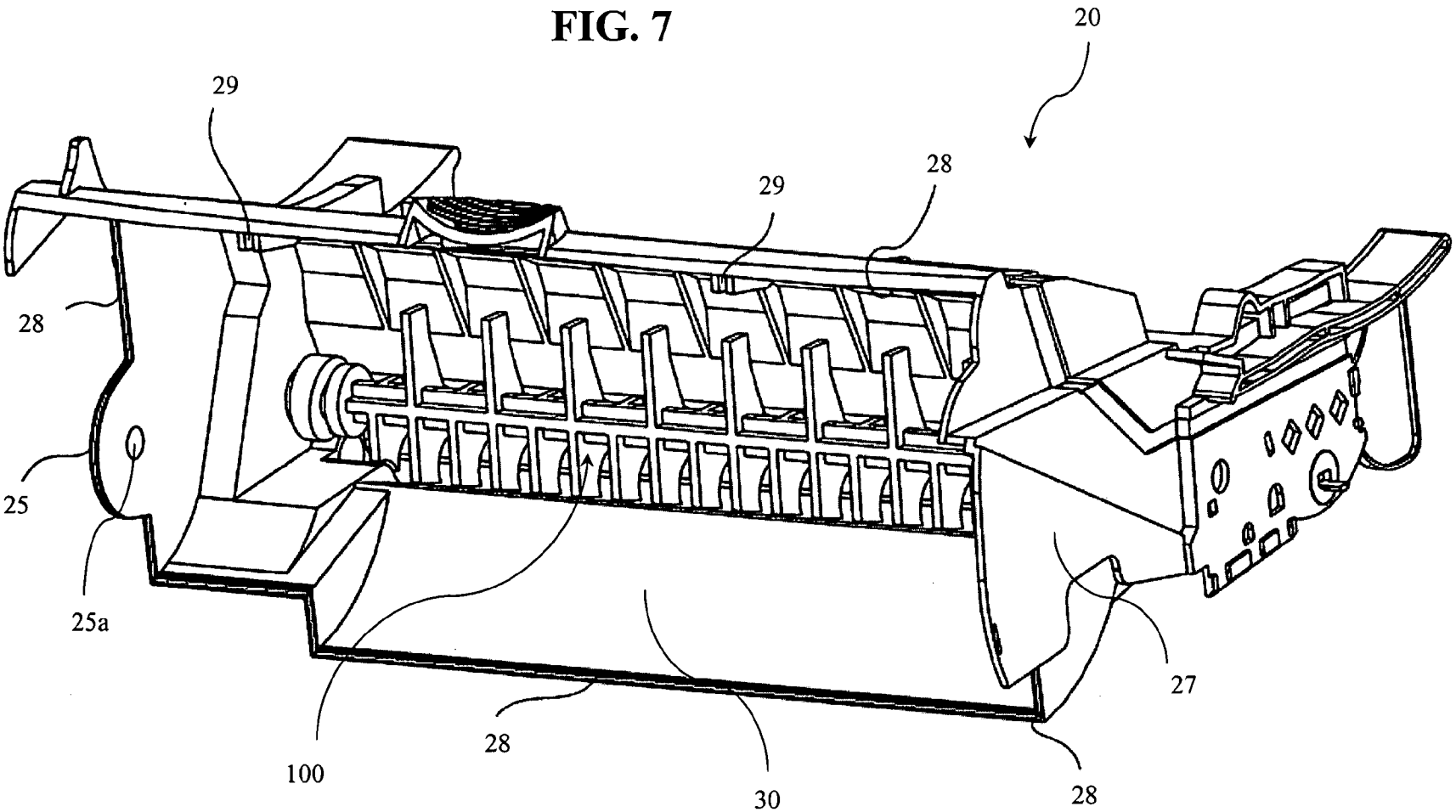
FIG. 7 is a rear perspective view of the main body of the novel toner cartridge showing the first embodiment of the sifting agitator.

As depicted in FIG. 7, the trailing end of main body 20 is open, defining a space between the lateral walls thereof. On one end of main body 20 the side wall extends outward to form a male-connection point 25, received by rear housing 40, as discussed below. An opening 25*a* is disposed within male-connection point 25 through which extends the primary shaft of the beater/measuring device (discussed below) to communicate with the gear which drives the toner beater measuring device.

The adjacent side wall is adapted with a semi-circular inward recess defining a female-connection point 26 to receive a corresponding male-connection point on rear housing 40. Protective cover 27 is disposed adjacent to the side wall comprising female-connection point 26 to prevent external forces, while in use or in storage, from causing damage to the moving parts of the toner cartridge. Protective cover 27 also provides a contact point for a pin located on the encoder disk of the beater mechanism, opposite the gear which drives the rotation thereof. This contact point prevents lateral movement of the encoder disk during operation.

Figure 4A:
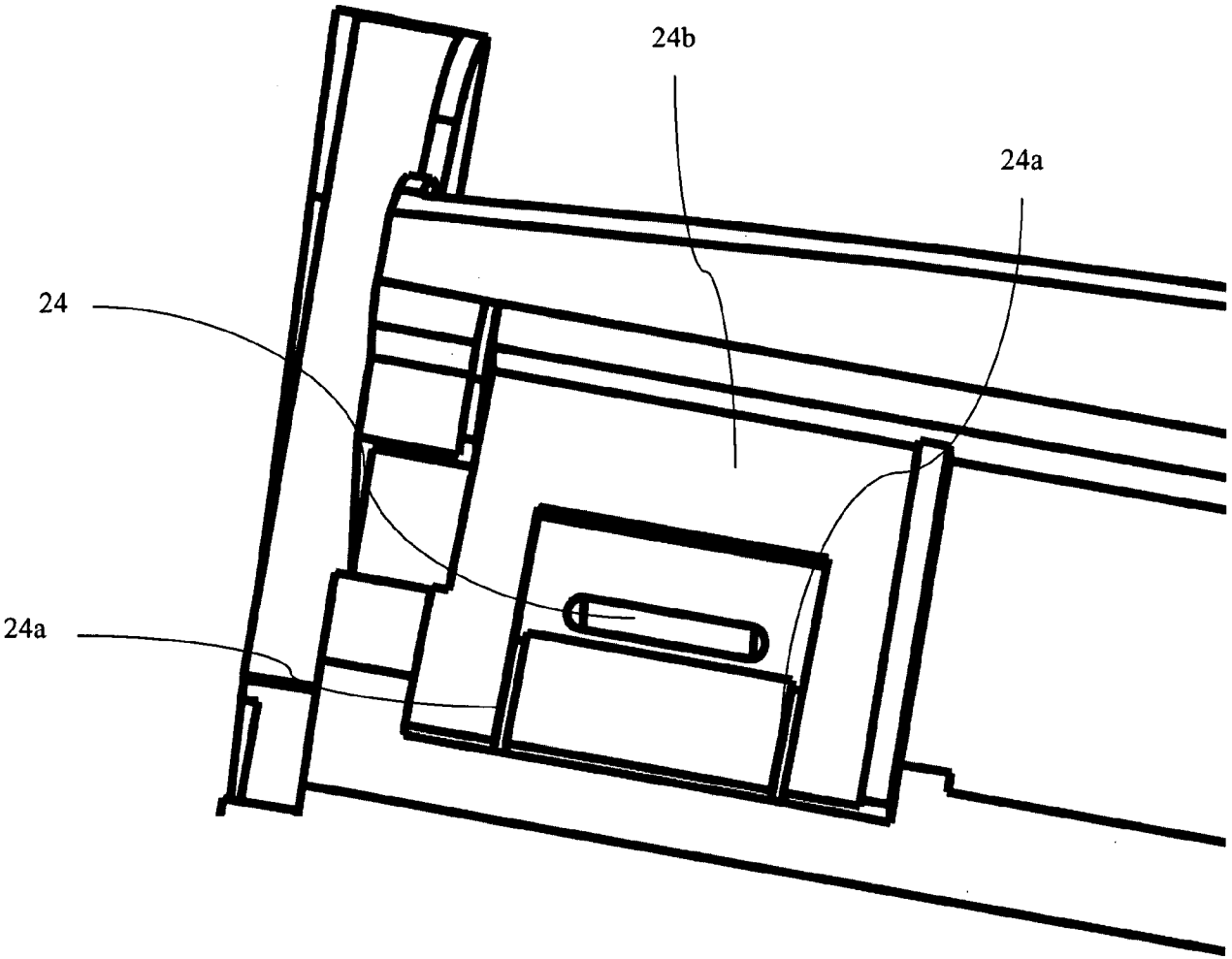
FIG. 4A is a close-up top perspective view of the vent apparatus disposed within the main body.

Main body 20 is equipped with vent 24 (see FIGS. 4 and 4A). Vent 24 permits air to enter the toner chamber as toner leaves the toner chamber, thus facilitating the flow of toner. Without vent 24, a vacuum builds within the toner cartridge and the resulting nternal pressure would prevent the out-flow of toner. A filtration material, such as felt, fits over vent 24 to prevent toner from escaping through vent 24. The filter material must be sufficiently permeable to allow air to pass into the toner chamber, while sufficiently impermeable to prevent the escape of toner. Air channels 24*a* allow air to flow to vent 24 when a circuit board or retaining material is placed over circuit board-receptacle 24*b*.

Figure 7A:
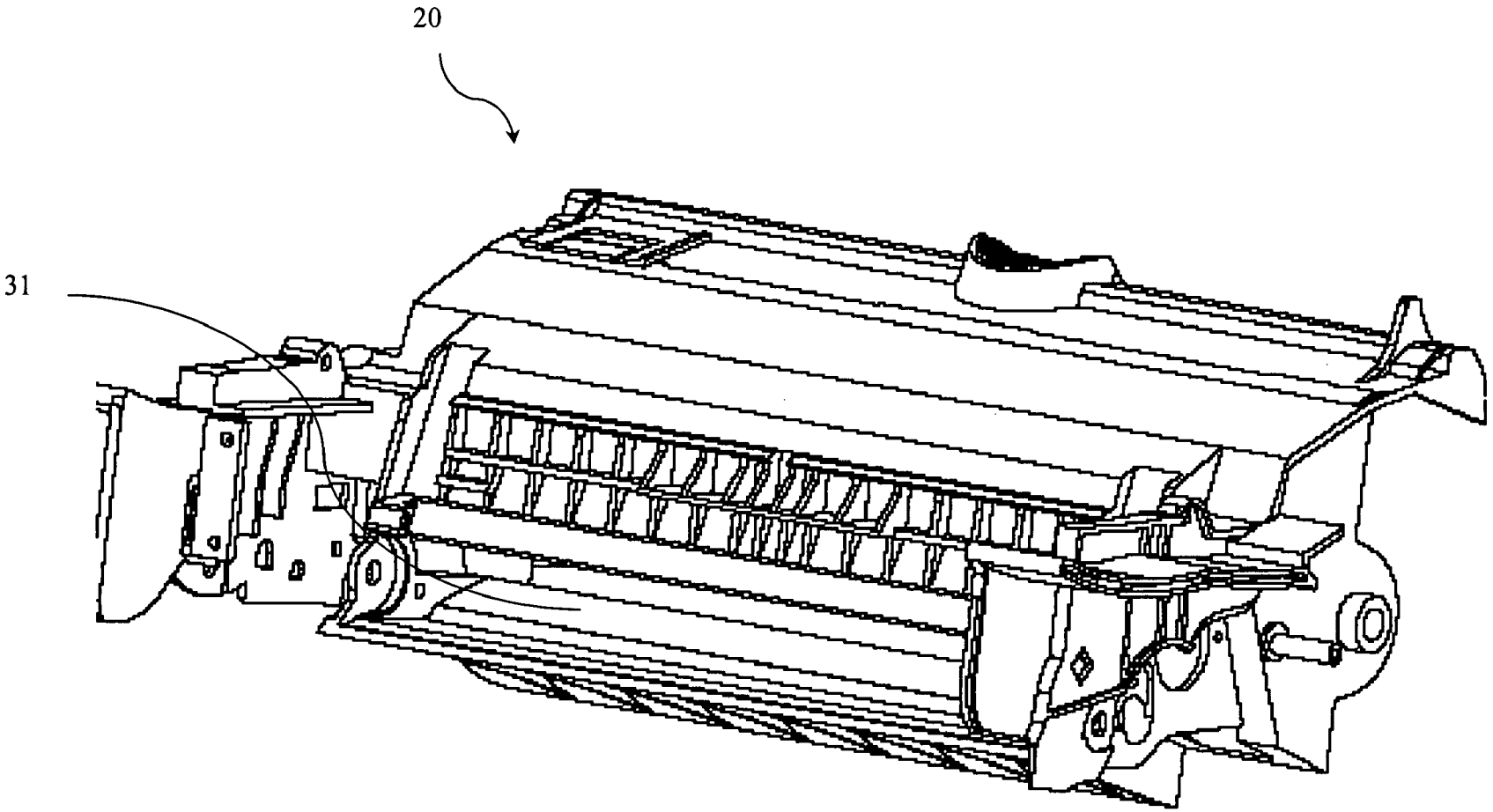
FIG. 7A is a front perspective view of the main body of the novel toner cartridge.

Referring again to FIG. 7, lower wall 30 of the toner chamber terminates at a point substantially above the bottom surface of the toner chamber. Lower wall 30 terminates as flat surface 31 (FIG. 7A). The exit surface of the toner extends from flat surface 31 downwardly toward the toner adder roller (not shown).

Figure 8:
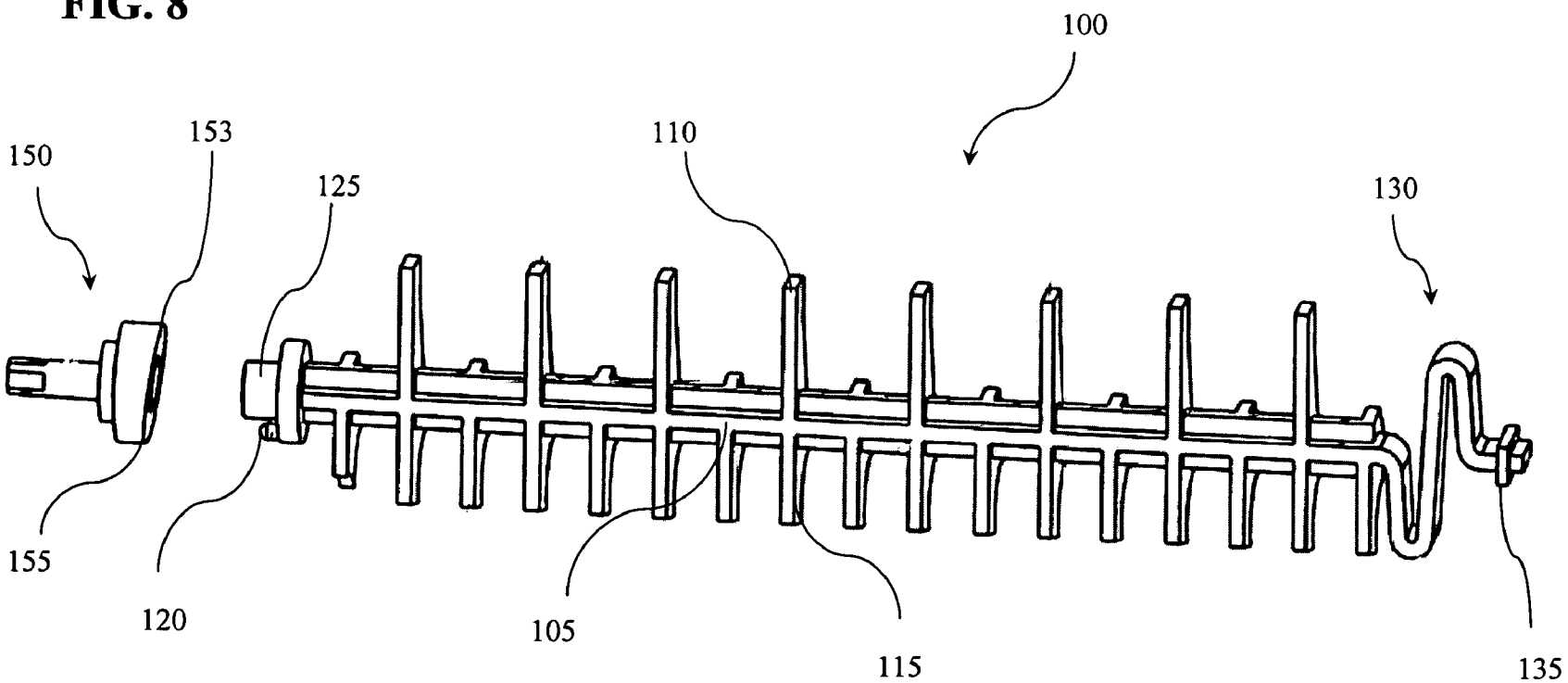
FIG. 8 is an exploded perspective view of the first embodiment of the sifting agitator.
Figure 9:
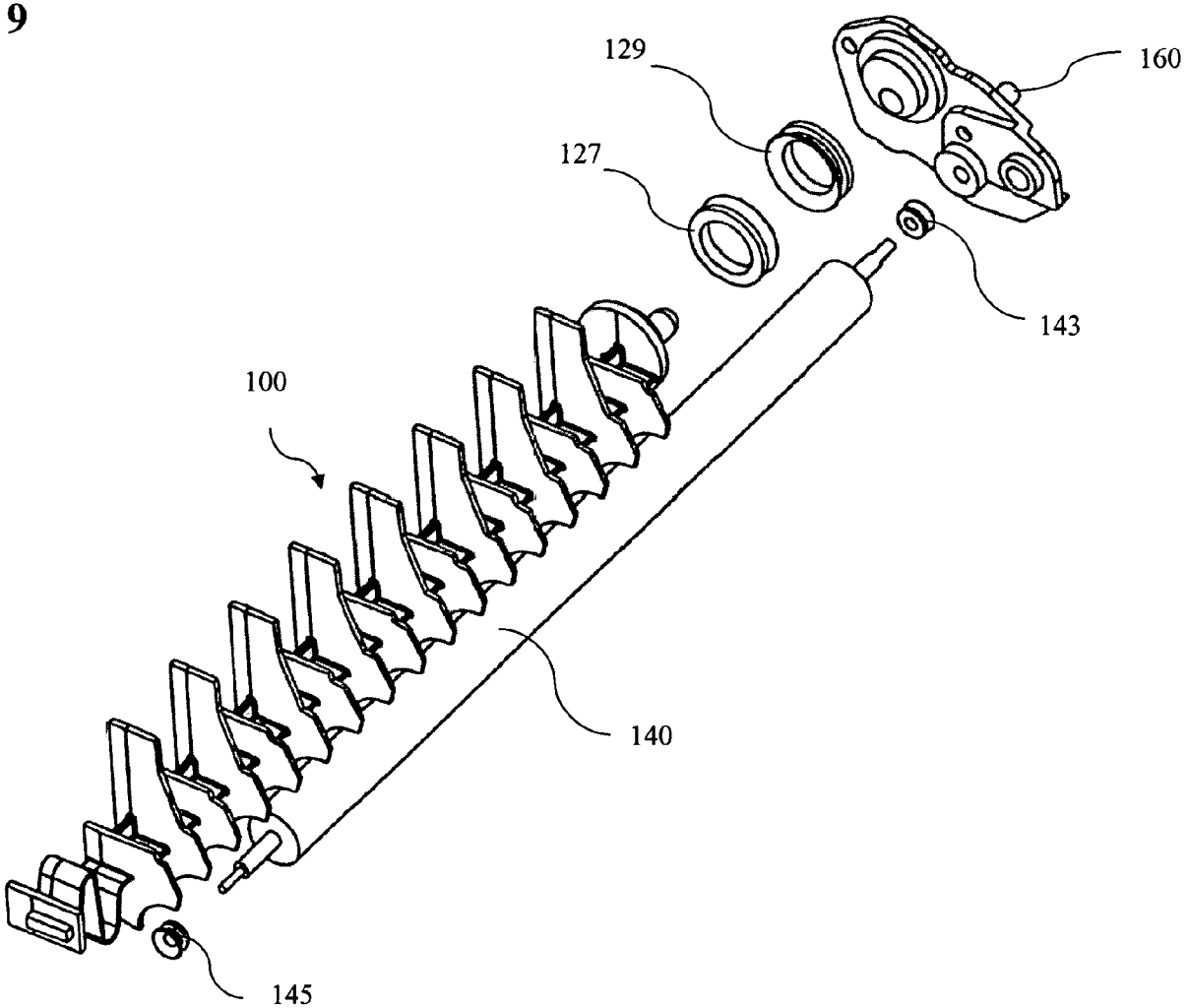
FIG. 9 is an exploded perspective view of the inter-relation of the sifting agitator, conforming seals, toner adder roller, and gear plate.
Figure 10:
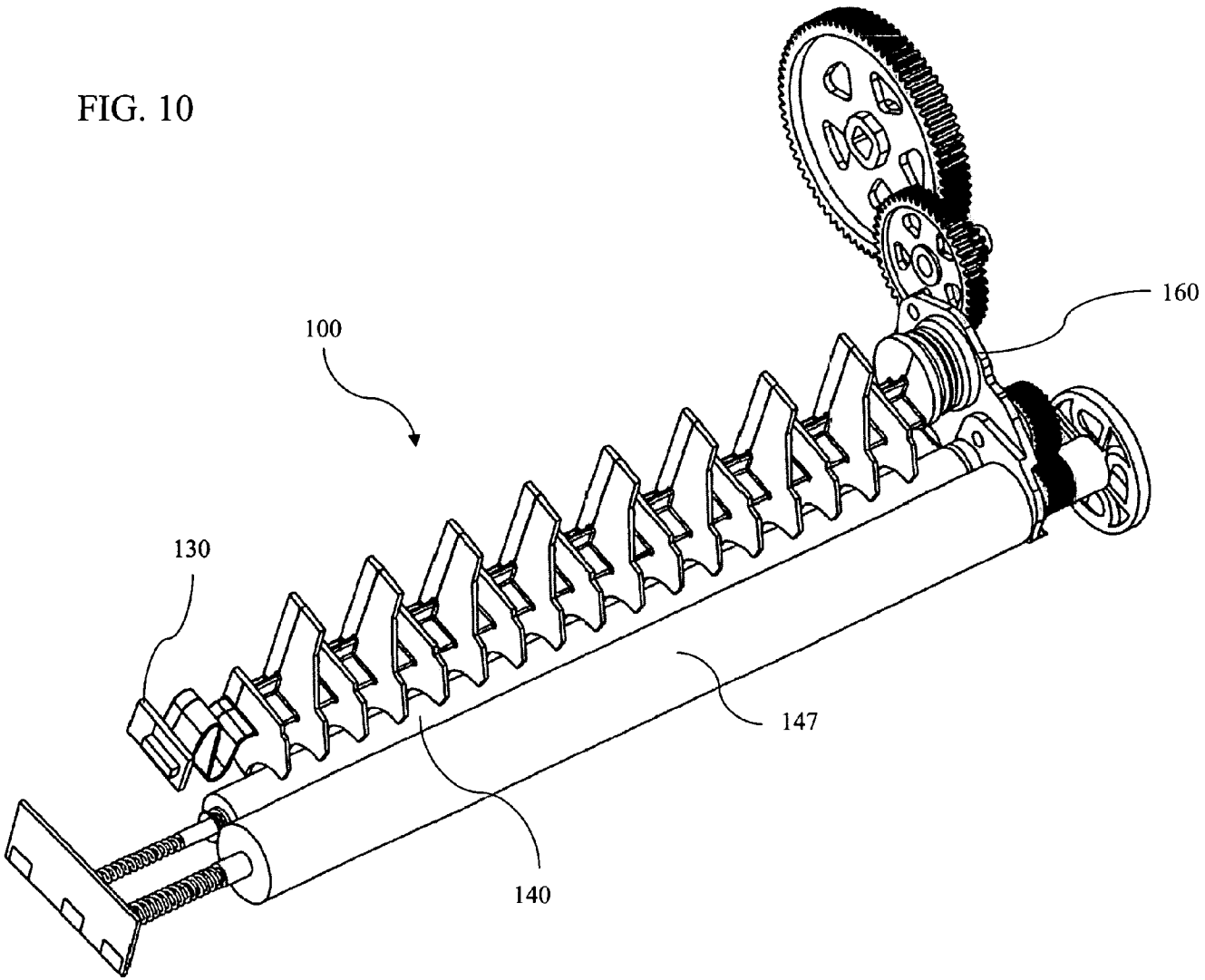
FIG. 10 is a perspective view of the inter-relation of the sifting agitator, conforming seals, toner adder roller, gear plate, developer roller, and gear train.

Sifting agitator 100 extends across flat surface 31 (FIG. 7A). Turning now to FIG. 8, sifting agitator 100 comprises shaft 105, upper fins 110, lower chamber contouring fins 115, cam pin 120, axle 125, biasing spring 130, and pin 135. In a general embodiment, sifting agitator 100 oscillates across flat surface 31 during printer operations. Toner spreads evenly across the exit surface of the toner cartridge as lower chamber contouring fins 115 sift the exiting toner. FIGS. 9 and 10 show how lower chamber contouring fins 115 curve to fit toner adder roller 140 to ensure the closeness of sifting agitator 100 to toner adder roller 140. In so doing, toner disperses evenly across the exit surface immediately prior to contact with toner adder roller 140. The sifting agitator doesn't contact the adder roller but closely contours the lower surface of the toner chamber and the adder roller, thus assuring the toner stays sufficiently fluid and level near the adder roller.

Conforming seals 127 and 129 are disposed at the end of sifting agitator 100 to engage gear plate 160 and prevent the escape of toner from the sides of the cartridge. Similarly, conforming seals 143, 145 are placed on either end of toner adder roller 140.

Figure 11:
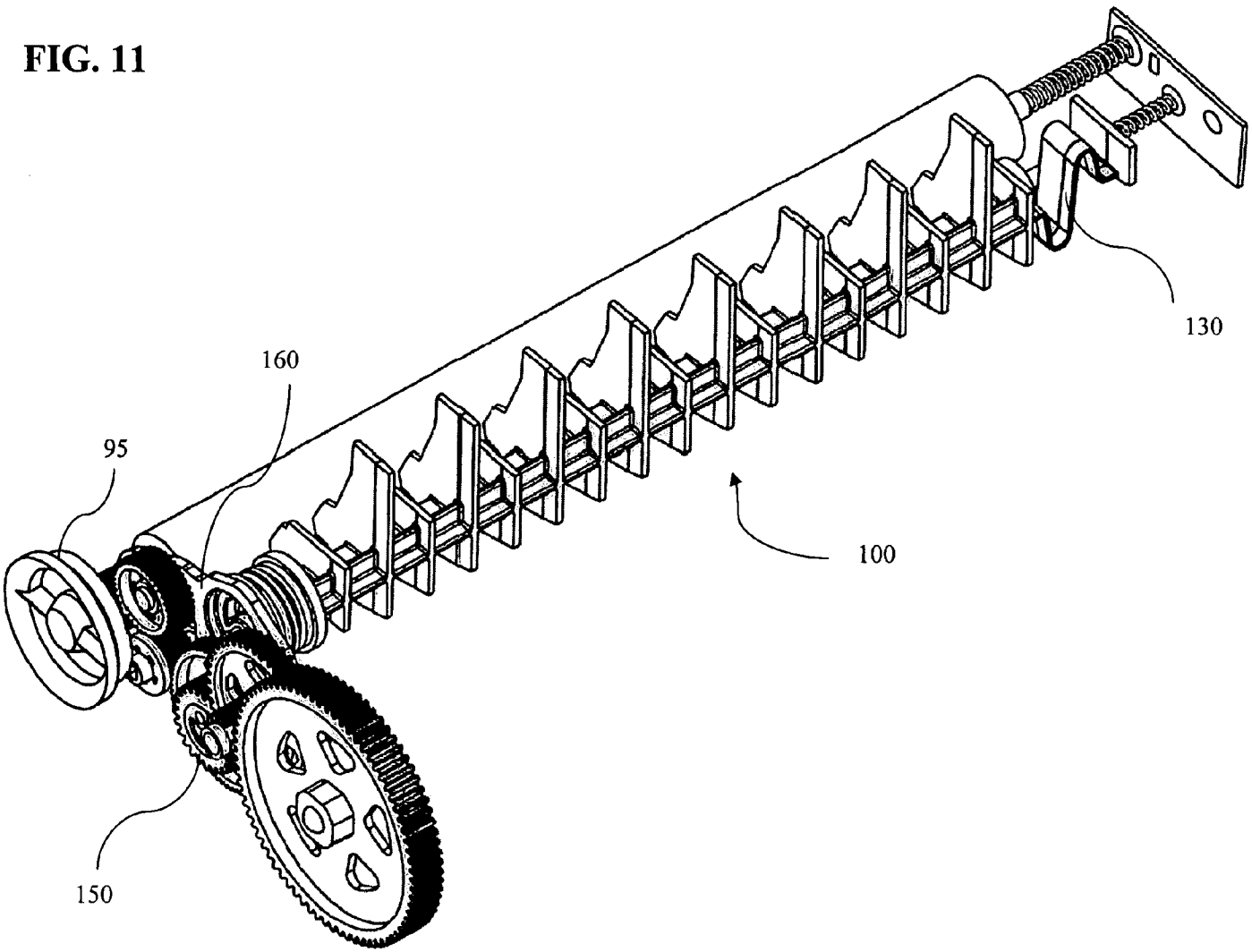
FIG. 11 is an alternate perspective view of the interrelation of the sifting agitator, conforming seals, toner adder roller, gear plate, developer roller and gear train.

FIG. 11 shows how toner sifter 100 oscillates across flat surface 31. In FIG. 11, drive dog gear 95 engages the drive apparatus of the printer (not shown). Rotation of drive dog gear 95 provides the rotational force for all gears in the gear train shown in FIG. 11. Rotation of cam gear 150 applies lateral force on sifting agitator 100 by means of a beveled inner surface which engages and disengages pin 120 (FIG. 12).

Lateral movement of sifting agitator 100 away from the gear train causes biasing spring 130 to compress. When cam gear 150 disengages pin 120, biasing spring 130 expands returning sifting agitator to its home position. Spring biasing means 130 mounts on sifting agitator and engages the interior of the toner chamber by means of pin 135. Thereby, after sifting agitator 100 is moved from its home position by cam gear 150, the potential energy stored in biasing spring 130 is exerted against sifting agitator 100 to return it to its home position. In addition to the biasing spring shown in FIGS. 8–11, any resilient means for exerting the necessary force on sifting agitator 100 to return it to its home position are contemplated.

Figure 12:
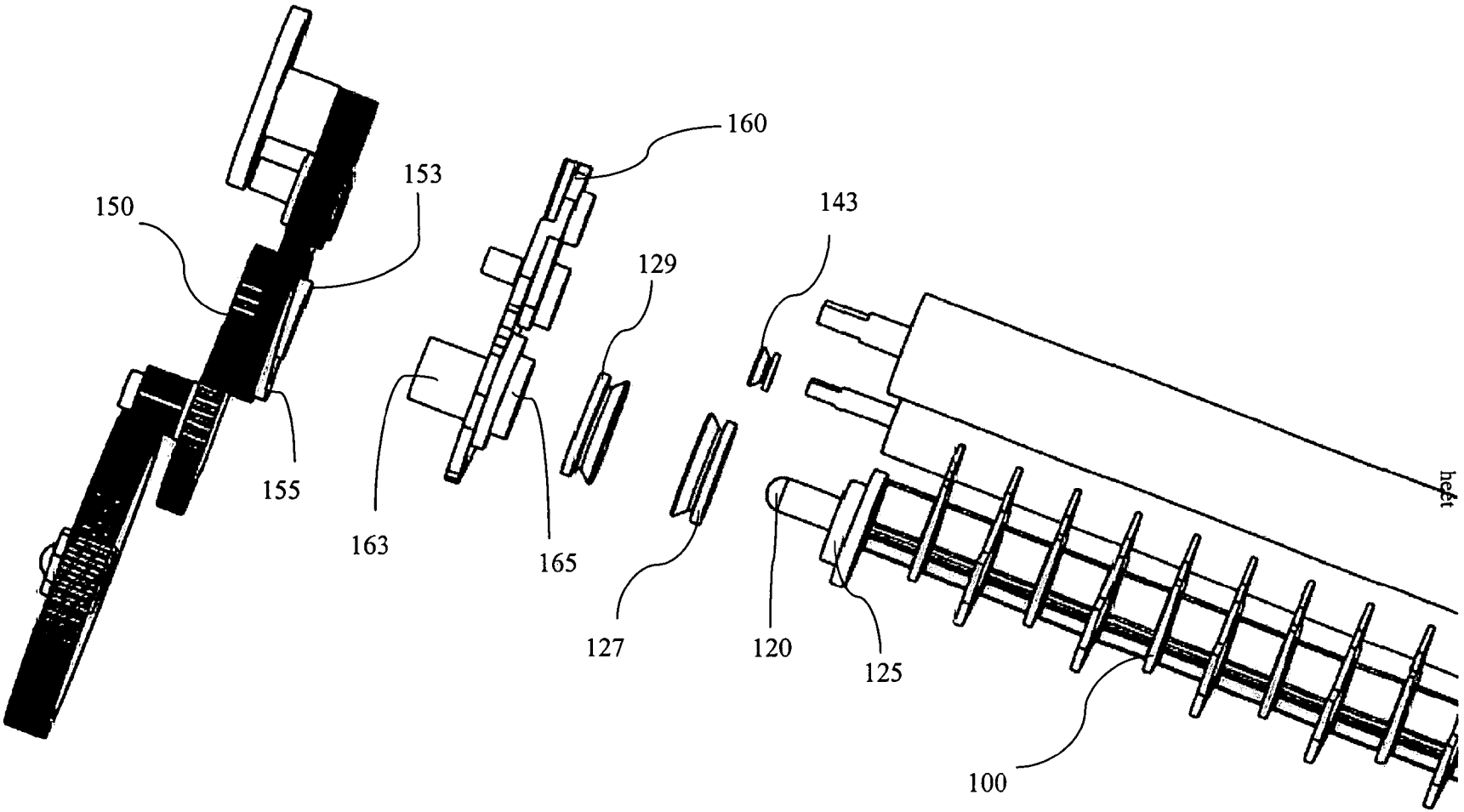
FIG. 12 is an exploded perspective view of the interrelation of the sifting agitator, conforming seals, toner adder roller, gear plate, developer roller and gear train.
Figure 13:
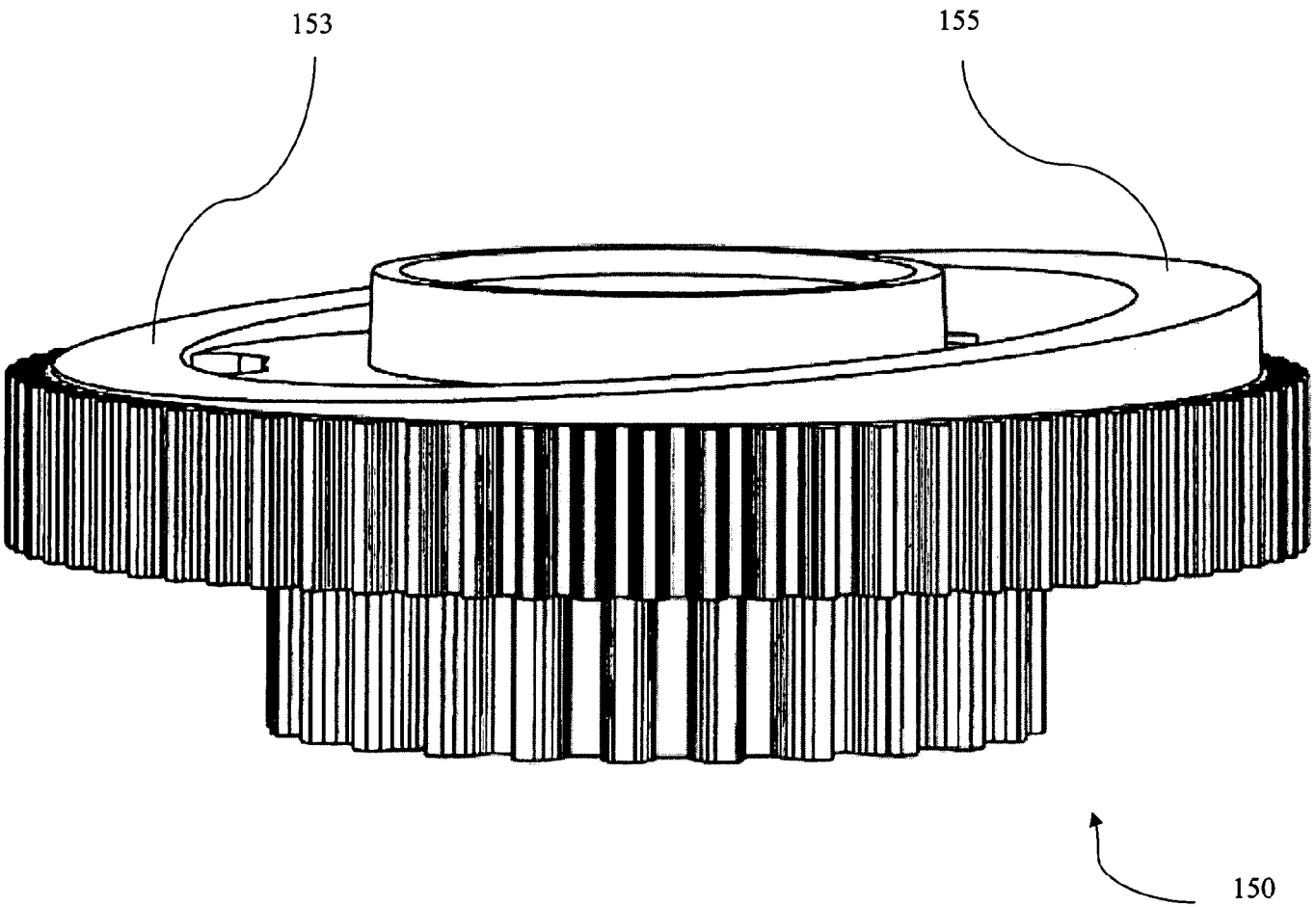
FIG. 13 is a side perspective view of the cam gear.

FIG. 12 shows an exploded view of the connection between sifting agitator 100 and cam gear 150 through gear plate 160. As it can be seen, shaft 105 of the sifting apparatus terminates in axle 125 which includes cam pin 120. Conforming seal 127 rests on the outer circumferential edge of axle 125 and mates with conforming seal 129. Conforming seal 129 correspondingly rests on ridge 165 of gear plate 160. When fully assembled, cam pin 120 extends through gear plate 160. The inner surface of cam gear 150 is beveled and has a high surface 155 and low surface 153. Cam gear 150 rotates on cam axle 163 of gear plate 160. As cam gear 150 rotates, cam pin 120 is alternatively engaged by high surface 155 and disengaged by low surface 153. When high surface 155 engages cam pin 120 sifting agitator 100 is urged laterally away from gear plate 160. When low surface 153 rotates to a position adjacent to cam pin 120 the potential energy stored in biasing spring 130 urges sifting agitator 100 to return to its home position. The continued rotation of cam gear 150, and the coincident revolution of high surface 155, coupled with the resiliency of biasing spring 130 thereby create the oscillating movement of sifting agitator 100. Cam gear 150 is shown in greater detail in FIG. 13.

Figure 14:
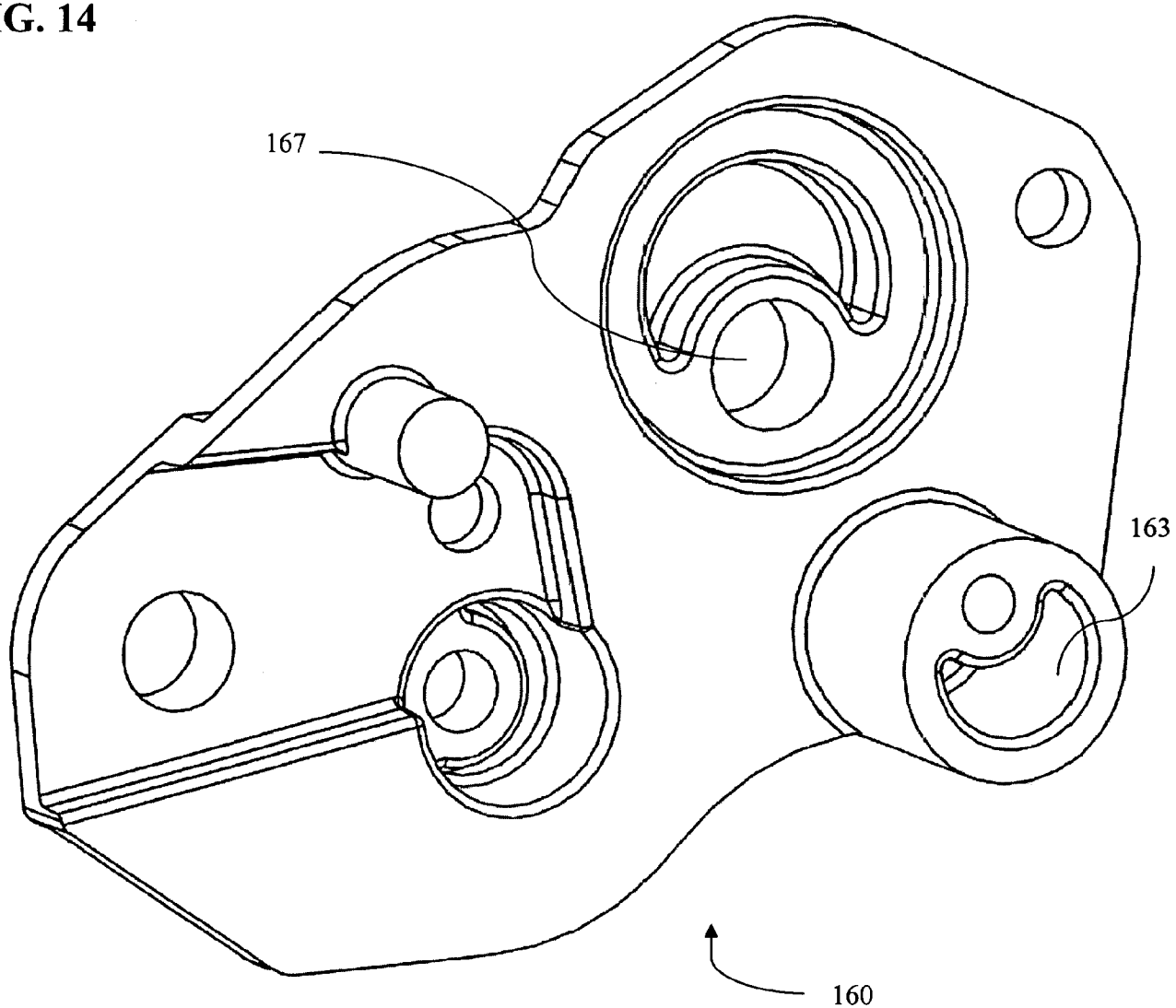
FIG. 14 is a side perspective view of the gear plate.
Figure 14A:
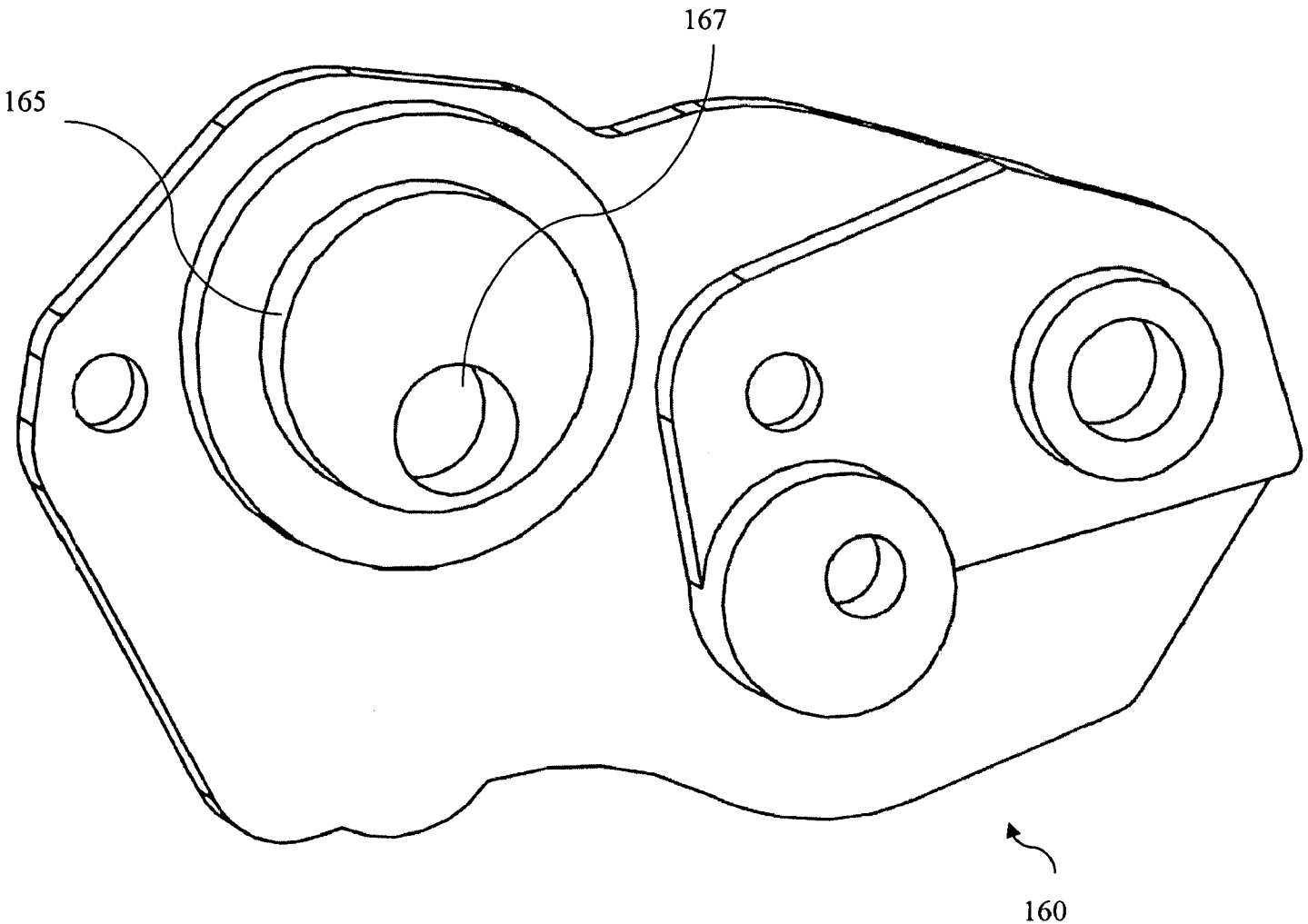
FIG. 14A is a side perspective view of the gear plate.

The outer surface of gear plate 160 is shown in FIG. 14. As mentioned above, cam gear 150 (not shown) rests and rotates upon cam gear axle 163. Cam gear pin 120 protrudes through gear plate 160 through aperture 167. Cam gear axle 163 is in displanar relationship to aperture 167 to ensure that high surface 155 and low surface 153 alternately engage and disengage cam pin 120 as cam gear 150 rotates. FIG. 14A provides a view of the reverse side of gear pate 160.

Figure 15:
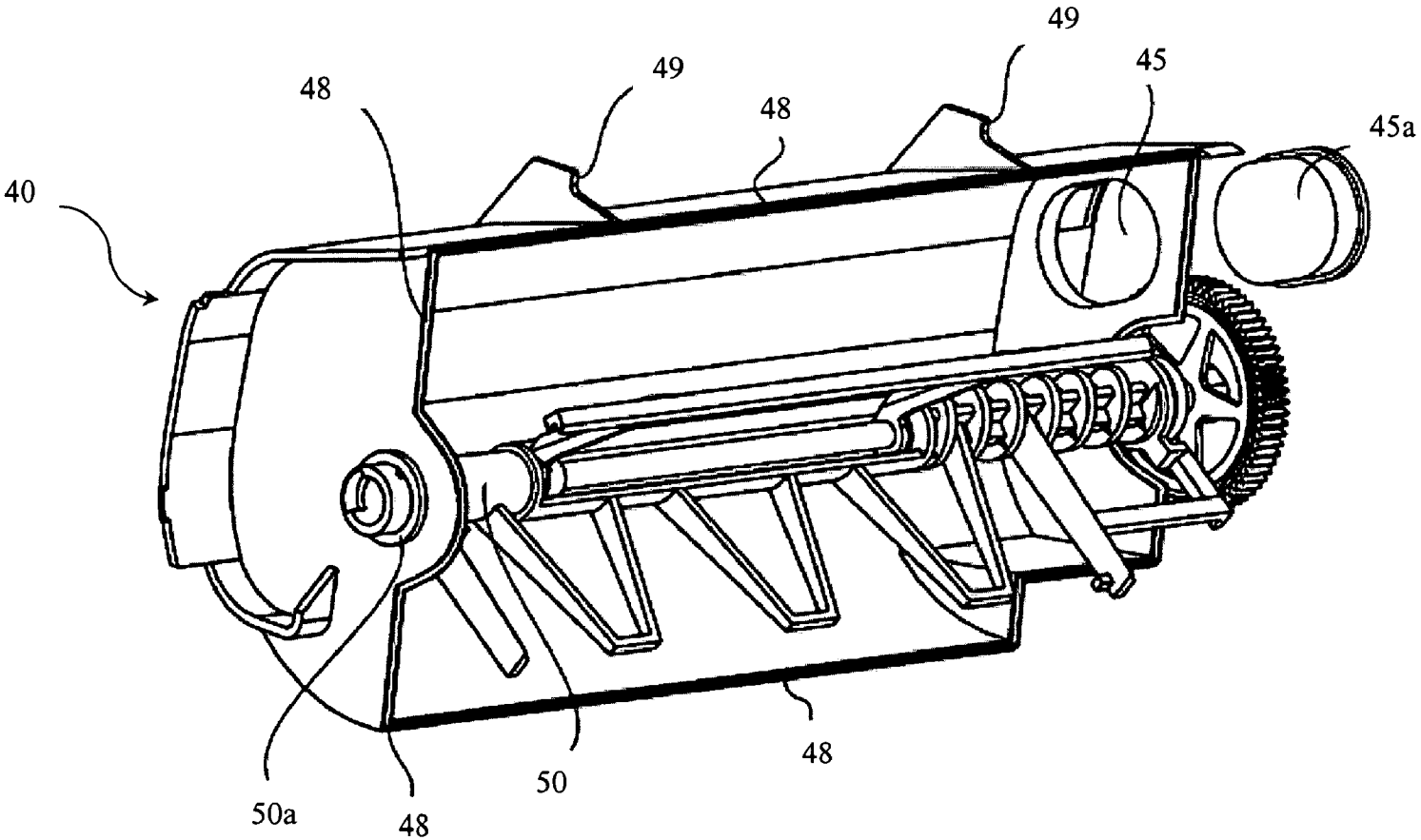
FIG. 15 is a front perspective view of the rear housing and oval plug of the novel toner cartridge.

Toner Chamber: As shown in FIG. 15, the leading edge of rear housing 40 has a perimeter of a connecting surface 48 in the fashion of a tongue-and-groove, to mate with a corresponding connecting surface 28 of main body 20 (FIG. 7). Rear housing 40 includes vertical tabs 49 formed on its upper surface that engage slots 29 formed on main body 20 (FIG. 7). Rear housing 40 can be adhered to main body 20 by any means known in the art. Illustrative examples include, but are not limited to, adhesives, welding, and mechanical fasteners.

When rear housing 40 mates with main body 20, a toner chamber is defined by the cavity formed therein. Toner is discharged from a lower portion of main body 20 and supplied to the toner-adder roller. The toner chamber holds fresh, unused toner and houses the beater and measuring bar. The toner beater and measuring bar extend from the primary drive shaft. The primary drive shaft is rotatably supported and driven, through a gear train, by a drive element in the laser printer. The toner beater and measuring bar agitate the toner, thus preventing the toner from becoming compacted. In this manner, the toner is kept sufficiently fluid to be discharged uniformly from main body 20.

Fill-hole 45 is disposed within the side wall of rear housing 40 (FIG. 15). Fill-hole 45 is preferably oval shaped, thus allowing air to escape the toner chamber as toner is funneled into the toner chamber. Fill-cap 45*a* is inserted into fill-hole 45 so toner cannot escape there through. In one embodiment fill-cap 45*a* is releasably placed within fill-hole 45 so the cartridge can be recycled and re-filled.

Figure 16:
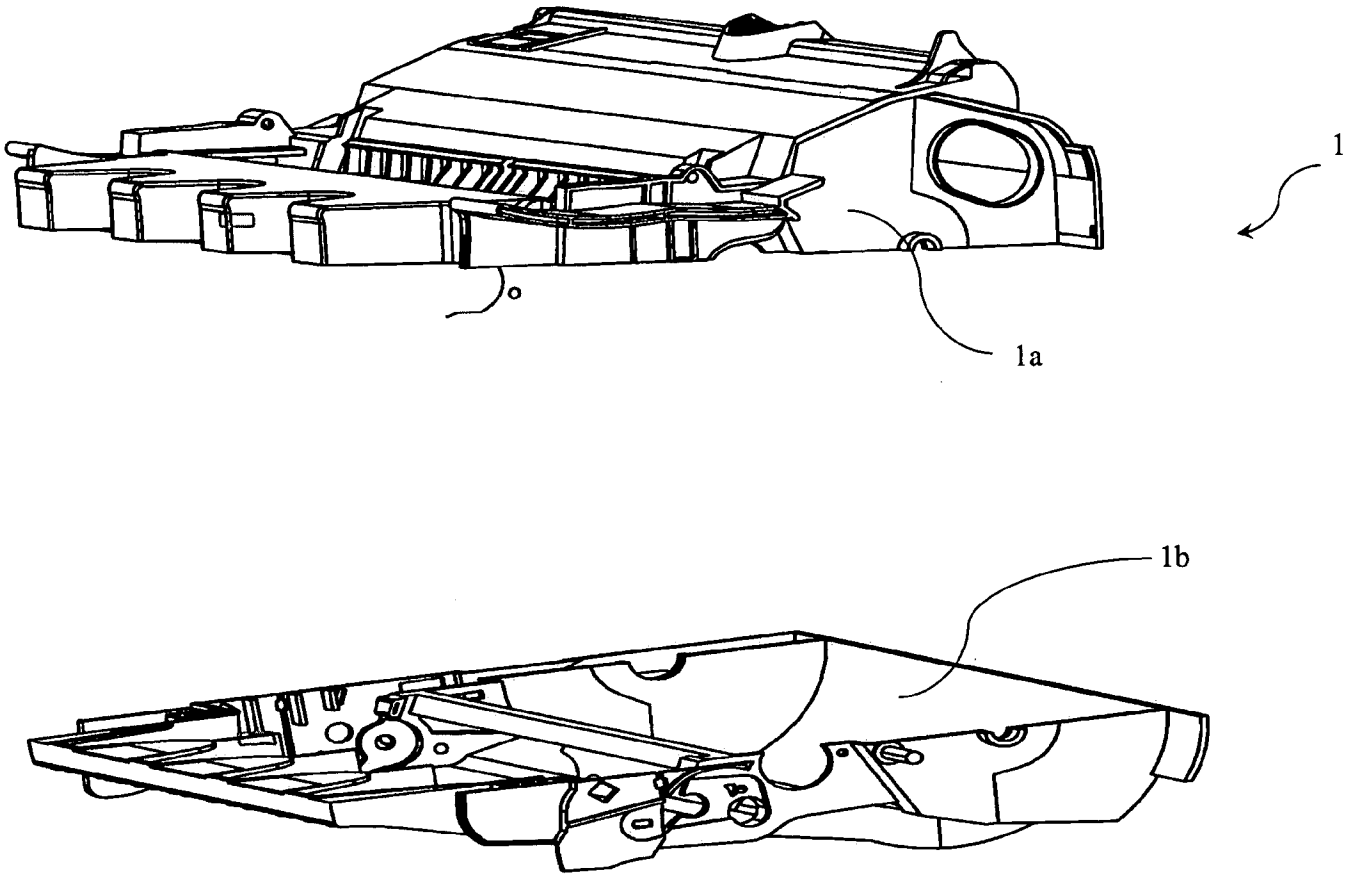
FIG. 16 is a perspective view of an alternative construction configuration of the novel toner cartridge.

Alternatively, the novel toner cartridge can be manufactured using two halves which are adhered together. For example, FIG. 16 shows an alternate construction method of toner cartridge 1 wherein top portion 1*a* is adhered to bottom portion 1*b*. It is also contemplated that similar construction can be achieved using a left and right portion adhered along their longitudinal access. This construction also permits the addition of the elements necessary for operation (photoconductive drum, beater, toner adder roller, etc.).

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described.

What is claimed is:

1. A toner cartridge adapted to fit within a toner cartridge-receiving cavity of a printer, comprising:

a main body having a first side equipped with a gear train and second side opposite the first side;

a toner chamber, having an exit surface to deliver toner from the toner chamber, connected to the main body at the trailing end of the main body; and a sifting agitator having a first end and a second end extending across the exit surface capable of lateral movement between the first and second side across the exit surface.

2. The toner cartridge of claim 1 further comprising: a cam having a high surface and a low surface disposed at a first end of the sifting agitator such that rotation of the cam alternately engages and disengages the first end of the sifting agitator as the cam rotates.

3. The toner cartridge of claim 1 further comprising: a spring mounted to one end of the sifting agitator for exerting force on the agitator to return the agitator to a home position.

4. The toner cartridge of claim 3 wherein the spring is mounted on the sifting agitator and has a portion engaging the interior of the toner chamber.

5. The toner cartridge of claim 3 wherein the spring is a convoluted, resilient, and flexible extension of the sifting agitator.

6. The toner cartridge of claim 1 further comprising: a toner adder roller.

7. The toner cartridge of claim 6 wherein the sifting agitator includes a plurality of lower chamber contouring fins spaced along the longitudinal axis of the sifting agitator adapted to move in lateral, relation to the toner adder roller.

8. The toner cartridge of claim 1 further comprising: a plurality of upper fins spaced along the longitudinal axis of the sifting agitator.

9. The toner cartridge of claim 2 further comprising: a cam pin disposed at the first end of the sifting agitator to engage the high surface of the cam as it rotates urging the sifting agitator to move laterally away from the cam.

10. A toner cartridge adapted to fit within a toner cartridge-receiving cavity of a printer, comprising:

a main body having a first side equipped with a gear train and second side opposite the first side;

a toner chamber, having an exit surface to deliver toner from the toner chamber, connected to the main body at the trailing end of the main body;

a sifting agitator having a first end and a second end extending across the exit surface capable of lateral movement between the first and second side across the exit surface; and a cam having a high surface and a low surface disposed at the first end of the sifting agitator such that rotation of the cam alternately engages and disengages the first end of the sifting agitator as the cam rotates.

11. A toner cartridge adapted to fit within a toner cartridge-receiving cavity of a printer, comprising:

a main body having a first side equipped with a gear train and second side opposite the first side;

a toner chamber connected to the main body at the trailing end of the main body having an exit surface to deliver toner from the toner chamber;

a sifting agitator having a first end and a second end extending across the exit surface capable of lateral movement between the first and second side across the exit surface; and a cam having a high surface and a low surface disposed at a first end of the sifting agitator such that rotation of the cam alternately engages and disengages the first end of the sifting agitator as the cam rotates; and a spring mounted to one end of the sifting agitator for exerting force on the agitator to return the agitator to a home position.

* * * * *